US008622062B2

(12) United States Patent
Dragos

(10) Patent No.: US 8,622,062 B2
(45) Date of Patent: Jan. 7, 2014

(54) TOEZEEZE—A BIODEGRADABLE, WATER SOLUBLE INDIVIDUAL TOE SEPARATOR USED IN PEDICURES

(76) Inventor: Shari Dragos, Boca Raton, FL (US)

( * ) Notice: Subject to any disclaimer, the term of this patent is extended or adjusted under 35 U.S.C. 154(b) by 169 days.

(21) Appl. No.: 13/152,440

(22) Filed: Jun. 3, 2011

(65) Prior Publication Data

US 2011/0284018 A1 Nov. 24, 2011

Related U.S. Application Data

(63) Continuation-in-part of application No. 11/975,462, filed on Oct. 18, 2007, now abandoned.

(60) Provisional application No. 60/951,446, filed on Jul. 23, 2007.

(51) Int. Cl.
*A45D 7/00* (2006.01)
*A45D 29/00* (2006.01)

(52) U.S. Cl.
USPC ..... 132/200; 132/73

(58) Field of Classification Search
USPC ..... 132/73, 200, 73.5; 2/239–242; D2/980; 36/94
See application file for complete search history.

(56) References Cited

U.S. PATENT DOCUMENTS

| | | | | |
|---|---|---|---|---|
| 2,517,232 | A * | 8/1950 | Patulski | 132/73 |
| 5,853,848 | A * | 12/1998 | Fisk | 428/143 |
| 5,906,007 | A * | 5/1999 | Roberts | 2/239 |
| 6,704,941 | B1 * | 3/2004 | Palm | 2/239 |
| 2010/0251569 | A1 * | 10/2010 | Stern | 36/94 |
| 2012/0152267 | A1 * | 6/2012 | Chang | 132/200 |

* cited by examiner

*Primary Examiner* — Robyn Doan

(57) ABSTRACT

A system to facilitate pedicures and all applications where comfortable toe separation is demanded. The system consists of small water soluble tubular devices that fit in between each toe to ensure adequate spacing between the toes while polish is applied during a pedicure or other treatment to toes is required. The entire composition is made of water soluble corn starch and may be left in place when using your own sandal, flip flop or other open toed shoe when your services are complete.

1 Claim, 6 Drawing Sheets

TOEZEEZE—A BIODEGRADABLE, WATER SOLUBLE INDIVIDUAL TOE SEPARATOR USED IN PEDICURES

CROSS-REFERENCE TO RELATED APPLICATIONS

The present application is a continuation in part of parent patent application Ser. No. 11/975,462 dated Oct. 18, 2007, now abandoned U.S. provisional application No. 60/951,446 dated Jul. 23, 2007

BACKGROUND OF THE INVENTION

Background

Pedicures are typically performed in a salon or spa. Typically a pedicure includes painting toenails with polish which may take an hour to fully dry. One of the issues for someone who gives a pedicure is separating toes properly so painting the nails is an easier task. The other issue is keeping the toes from getting to close to one another while the polish is being applied or is still wet so as to prevent smearing or scratching while the nail dries.

Therefore, it is desirable to provide a pedicure system wherein a foot may be easily inserted into your own sandal, flip flop, or open toed shoe while wearing the pedicure toe separators so that you may leave the salon or spa and have the peace of mind that the invention is comfortable and is safe for the environment because it is made of water soluble corn starch.

DESCRIPTION

Field of the Invention

The present invention relates generally to toe separation to more effectively perform a pedicure or services to individual toes. To utilize the toe separators the pedicurist simply pinches to sort of mold it to gain the desired thickness then wedges the soft comfortable pieces in between the dry toes before applying polish. The goal is to separate the toes to have them remain in place until the polish dries. The material made of corn starch which is biodegradable, soft and can be molded and will dissolve in water. Although the invention has been shown and described with respect to certain preferred embodiments, other equivalents and modifications will occur to others skilled in the art upon the reading and understanding of the specification. The present invention includes all such equivalents and modifications, and is limited only by the scope of the claims.

SUMMARY OF THE INVENTION

In view of the disadvantages inherent in the known types of pedicure shoes, sandals and other footwear of known designs and configurations, the present invention provides an improved environment friendly and simple system. As such, the general purpose of the present invention is to provide a new and improved system and method which has all the advantages of the prior art and none of the disadvantages. The material used consists of corn starch and is intended to dissolve under running water. The intention is only to separate the toes comfortably during a pedicure and not be concerned of hurting the environment as it is biodegradable and will dissolve under running water.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Likewise, elements and features depicted in one drawing may be combined with elements and features depicted in additional drawings. Moreover, in the drawings, like reference numerals designate corresponding parts throughout the several views.

Figure 1:
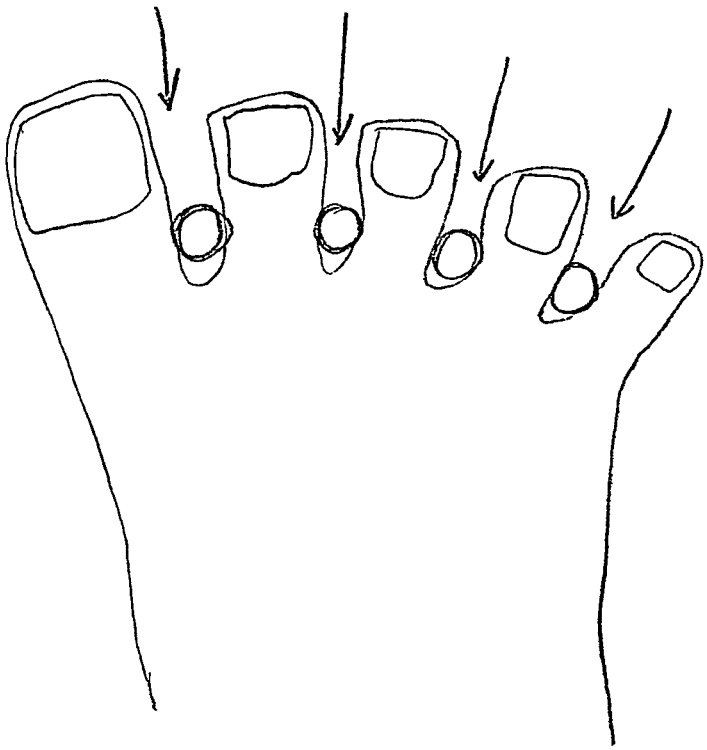
FIG. 1. is a view overlooking the top of the foot displaying the toe separators in between each toe.
Figure 2:
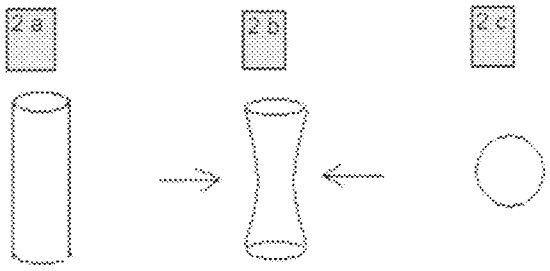
FIG. 2*a* is a vertical view of the toe separator
FIG. 2*b* is a vertical view of the toe separator s it would be when placed between the toes, the soft material as it conforms to the space between the toes.
FIG. 2*c* is a top view of the toe separator
Figure 3:
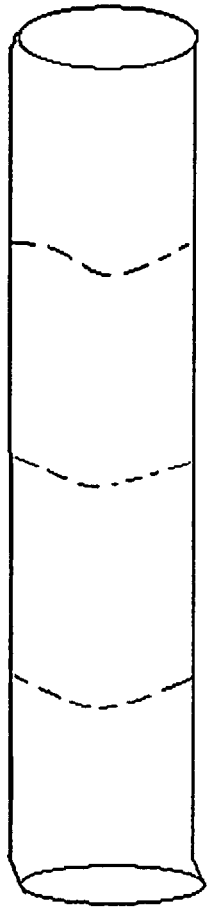
FIG. 3 is another form in which the separators may be dispensed. Instead of individual pieces they may come in a perforated rod shape that can be torn off into several pieces for use as a toe separator.
Figure 4:
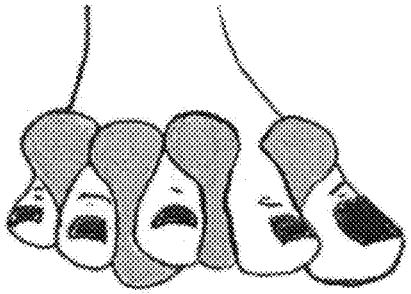
FIG. 4, Is a view of 4 toezeeze placed between toes to separate them for a pedicure.
Figure 5:
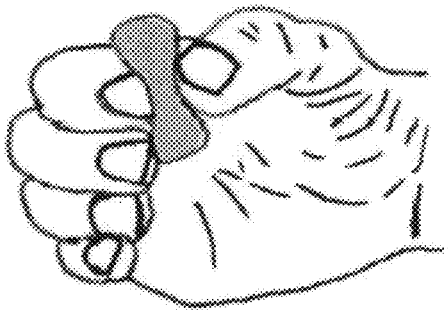
FIG. 5. Is a view of an individual toezeeze that has been pinched in the middle so it can be placed between 2 toes to separate them.
Figure 6:
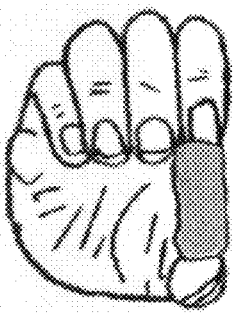
FIG. 6. Is a direct view of 1 individual Toezeeze in its original form.

What is claimed is:

1. A method of separating toe nails while applying polish material to the toe nails comprising of the steps of:

a) providing a soft pliable puffy round tubular shape ranging from ½ inches to 1 and ½ inches having a variety of different colors and being made of corn starch material; the toe separator being molded and formed of biodegradable material and will dissolve under running water, b) gently pinching each of the toe separators along the center as you place them between the toes for comfort and applying nail polish material onto the nails;

wherein the toe separators remain in place until the polish dries.

* * * * *